US010490878B2

(12) United States Patent
Adams

(10) Patent No.: US 10,490,878 B2
(45) Date of Patent: Nov. 26, 2019

(54) PHASE MATCHED COUPLE-RESONATOR 2.4 GHZ WIFI ANTENNA FOR LAPTOP COMPUTERS AND MOBILE DEVICES

(71) Applicant: James Davis Adams, Willamina, OR (US)

(72) Inventor: James Davis Adams, Willamina, OR (US)

(73) Assignee: James D. Adams, Willamina, OR (US)

( * ) Notice: Subject to any disclaimer, the term of this patent is extended or adjusted under 35 U.S.C. 154(b) by 0 days.

(21) Appl. No.: 15/873,358

(22) Filed: Jan. 17, 2018

(65) Prior Publication Data

US 2019/0221916 A1 Jul. 18, 2019

(51) Int. Cl.

| | |
|---|---|
| ***H01Q 1/22*** | (2006.01) |
| ***H01Q 1/24*** | (2006.01) |
| ***H01Q 9/22*** | (2006.01) |

(52) U.S. Cl.

CPC ..... *H01Q 1/2258* (2013.01); *H01Q 1/2291* (2013.01); *H01Q 1/245* (2013.01); *H01Q 9/22* (2013.01)

(58) Field of Classification Search

CPC ..... H01Q 1/2258; H01Q 9/22; H01Q 1/245; H01Q 1/2291; H01Q 17/001

See application file for complete search history.

(56) References Cited

U.S. PATENT DOCUMENTS

| | | | | |
|---|---|---|---|---|
| 6,538,613 | B1 * | 3/2003 | Pursiheimo | H01Q 1/125 342/359 |
| 2010/0026589 | A1 * | 2/2010 | Dou | H01Q 1/2258 343/702 |
| 2012/0176608 | A1 * | 7/2012 | McCown | H01Q 1/1264 356/138 |

* cited by examiner

*Primary Examiner* — Daniel Swerdlow

(57) ABSTRACT

A lightweight 2.4 GHZ antenna designed to be clipped onto a laptop computer or mobile device to extend the range of operation. The device consists of a tubular plastic frame upon which wire loops and a reflector are mounted and aimed toward the intended source of Wi-Fi signal. Radio-Frequency energy is transferred bidirectionally from the antenna to embedded antennas in the laptop computer or mobile device so no hardwired connection is necessary. Operation requires no power. The device can be scaled to 5 GHz Wi-Fi and other frequency bands including cellular.

1 Claim, 1 Drawing Sheet

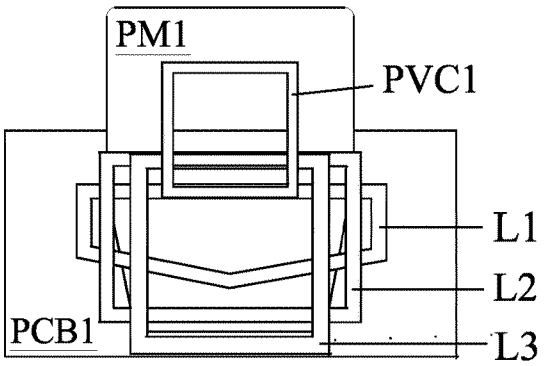
Fig. 2 Front View
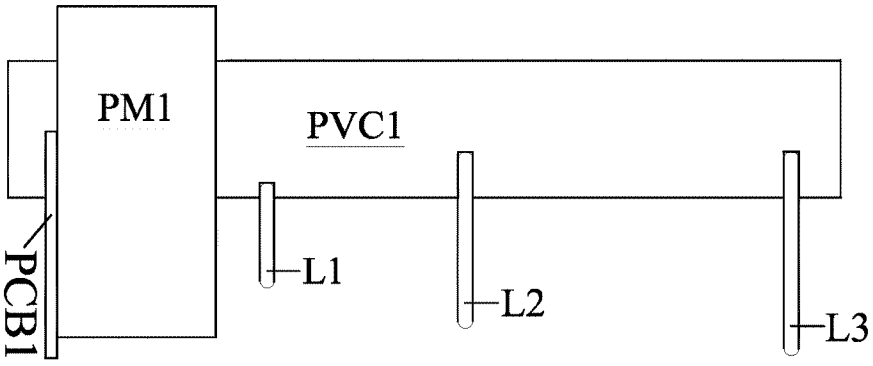
Fig. 1 Side View
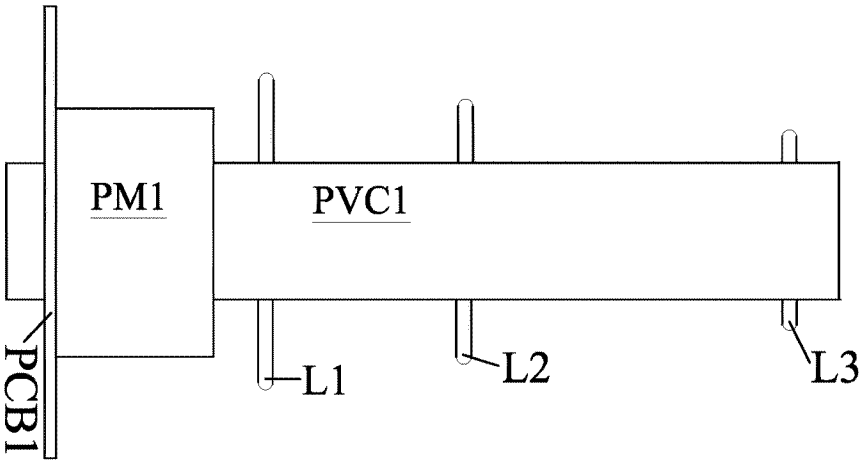
Fig. 3 Top View

PHASE MATCHED COUPLE-RESONATOR 2.4 GHZ WIFI ANTENNA FOR LAPTOP COMPUTERS AND MOBILE DEVICES

BACKGROUND OF THE INVENTION

The invention relates to Wi-Fi communications from 2400 MHz to 2500 MHz. The phase-matched coupled-resonator 2.4 GHz Wi-Fi antenna is a communications device designed to improve signal strength between computing devices and a router or hotspot, without any additional hardware.

Related technologies consist of external antennas that require an extra Wi-Fi adapter card and an RF cable to bypass the embedded antennas in a laptop computer. Also a standard exists for Near Field Communications that uses magnetic induction at 13.56 MHz to establish a link across a distance of up to 1.5 inches.

The invention functions by shaping a beam of 2.4 GHz Wi-Fi signal and delivering the signal bidirectionally and without delay to the embedded antennas of a laptop or mobile device. In this manner the output of the invention is in phase with the incident signal and the gain will be additive. Other 2.4 GHz Wi-Fi signals outside the beam will be received with normal signal level from the forward direction. The ability to superimpose in-phase signal gain upon the Wi-Fi uplink and downlink for selected hotspots is a unique feature of the invention.

My first prototype used a short section of 300 Ohm twinlead transmission line between a pick-up loop and the antenna that was trimmed to an electrical length of 1.77 wavelengths to synchronize the phasing. Without this phase match, the RF gain boost was not recognized by the Wi-Fi tuner in the laptop. A later prototype proved that I could sync to the incoming signal without any delays if the RF energy from the antenna could pass directly to the embedded antennas in laptops, essentially keeping pace with the RF traveling through the air. Simplifying the prototype to remove the transmission line and distribution lines to bring the antenna body up against the lid of the laptop solved this issue.

BRIEF SUMMARY OF THE INVENTION

The driven element of the invention is the focal point of RF energy entering and leaving through reciprocity. The driven element lays flat against the laptop display when the Wi-Fi antenna is clipped onto the bezel over where the embedded antenna is mounted. The mounting location is dictated by a 2 wavelength spatial diversity in laptops, and in mobile devices a closer spacing is typically used. A block of pliant material is used to hold the antenna in place on the edge of the computing device. Precise aiming of the Wi-Fi beam is achieved by sighting through the hollow body of the antenna. Field testing with various makes and models of laptop computers proved the concept was viable. The body of the invention is perpendicular to the plane of the laptop display or mobile device when in use. The concept is easily adapted to mobile devices which generally share a similar low-profile case with internal embedded antennas. The body of the structure in the Drawings is constructed of square plastic tubing, and the loops from copper wire. The pliant material is made from closed-cell polyethylene foam, and the reflector is a piece of Printed Circuit Board. The reflector and loops are mounted in slots cut in the PVC tubing.

The Wi-Fi phase matched coupled resonator antenna uses near-field coupled resonance centered at 2.45 GFIz between the laptop embedded antenna and the pick-up loop to establish a low-loss coupling of RF energy. The antenna uses both far-field and near-field modes of transmission. The path from the Wi-Fi hotspot to the front end of the antenna is far-field, while the path from the back of the antenna to the laptop is a near-field phenomenon that is a small fraction of a wavelength. Three loop elements and a reflector serve to increase the gain of the antenna to 15 dBi and set the input impedance at 75 Ohms looking through the gap into the driven element.

BRIEF DESCRIPTION OF DRAWINGS

Three views are shown on one page.

FIG. 1 is a side view that shows the square PVC tube PVC1 and the spacing of the antenna loops LI, L2, and L3.

FIG. 2 is a front view that shows the relative size and shaping of the antenna loops LI, L2, and L3, and the taper of the pliant material PM1.

FIG. 3 is a top view that shows another dimension of the reflector PCB1 and the pliant material PM1.

PVC1 is a square tube of PVC forming the body of the antenna. The walls are 1/16 inch thick. The dimensions are: length 4.75 inches, width 0.75 inches.

PM1 is a block of pliant material for holding the antenna to a laptop display bezel. Length 1⅞ inch, width 1⅜ inch, depth ⅞ inch.

PCB1 is a reflector made from copper-clad PCB. Width 2.5 inch, height 1.25 inch, thickness 0.062 inch.

LI is the antenna driven element and pick-up loop 1. Width 1.7 inch, height 0.35 inch tapering to 0.55 inch in the middle.

L2 is the antenna first director loop 2. Width 1.45 inch, height 0.93 inch.

L2 is the antenna second director loop 3. Width 1.1 inch, height 1.1 inch.

DETAILED DESCRIPTION OF THE INVENTION

The phase matched coupled-resonator antenna increases the gain of Wi-Fi signals by shaping the incoming and outgoing beams of Wi-Fi RF energy in the forward direction. As shown in FIG. 1 of the Drawing, the RF energy passes through two loop directors L3 and L2 and a driven loop element LI that progressively shape the RF into a rectangular form similar to that of the embedded antennas in the laptop computer or mobile device. The relative shapes of the antenna elements are shown best in FIG. 2, as the outermost loop L3 is closest to being circular so the gain is highest, and the innermost loop LI is shaped to interface efficiently with embedded antennas of the inverted-f or dipole style. The middle loop L2 is shaped to be dimensionally intermediate between LI and L3 and resonant at 2.45 GHz to facilitate the transfer of RF energy. The antenna elements are designed using Yagi antenna theory specially adapted for loop elements rather than dipoles, and modeled using the Numerical Electromagnetics Code.

The RF is coupled bidirectionally across the plastic bezel between the driven antenna element and the embedded antenna of the computing device. These elements share two fundamental properties, that of resonance centered on 2.45 GHz, and a rectangular shape of approximately 0.4 in.×1.70 in., as seen in the front view of LI in FIG. 2. With these parameters matched, and the gap between the elements of one tenth of an inch at this frequency band, the two antennas tend to resonate in tandem.

The 2 wavelength spatial diversity, with a wavelength at 2.45 GHz being 4.81 inches, allows for approximately 10 inches spacing between the two embedded antennas in a laptop. For a display that is 12 inches wide, the embedded antennas can usually be found 1 inch in from the upper corners of the display bezel. In mobile devices a closer spacing of 0.5 wavelength is typically used. Regardless of the exact method of mobile device construction, the location of the embedded antennas can be found by experimentation or by referring to product literature.

A block of closed-cell plastic foam material PM1 that is transparent to RF creates a slot to hold the antenna in place so the driven element is laying flat against the top of the laptop display. Closed-cell ethylene-vinyl acetate (EVA) or polyethylene foam are suitable materials for this part.

In practice the invention works best when the target Wi-Fi hotspot is in a line of sight from your location, although it is not required. Locate the laptop or mobile device so it can be directed toward the target with a minimum of foliage and obstructions. Slip the Wi-Fi antenna over the bezel of your computing device where the embedded antenna is located on whichever side is most convenient. To cover long distances, sight through the hollow antenna body PVC1 to frame the target in view. If the target was initially beyond the capture range, it should be detected by the Wi-Fi tuner momentarily. If it was already detected but too weak to use, the tuner may take a minute to resolve the change in amplitude before updating. With the Wi-Fi antenna in place, the range of a Wi-Fi connection can increase by a factor of three under good conditions.

The beam of the invention is perpendicular to the plane of the laptop display, so depending on which way the antenna is placed, the strongest Wi-Fi energy can be received from forward or rearward. The antenna frame PVC1 is composed of 0.75 inch square PVC tubing, but could also be constructed of injection-molded plastic to reinforce the mounting of the driven element on the underside. Square PVC tubing is preferred over round tubing due to the relative ease of drilling and cutting it accurately. At the back of the antenna the reflector PCB1 doubles the RF power in the forward direction, but may block weak signals coining from the rear.

To construct the Wi-Fi phase matched coupled resonator antenna prototype, the antenna components, reflector PCB1, pliant material PM1, driven element LI and directors L2, L3 are mounted to the square PVC tube PVC1 as shown in the three Figures, side view, front view, and top view in the Drawing. First cut the tubing to a length of 4.75 inches to make PVC1. To mount the reflector PCB1, come back a quarter inch from one end and cut a ⅜ inch long slot from one side to the other, perpendicular to the wall of the square tube. A standard hacksaw blade has the proper width to cut a slot for a standard thickness PCB, 0.062 inch. All the slots will be on the same side of the PVC tube PVC1. Cut a single or double-sided copper clad PCB to 2.5 by 1.25 inches to make PCB1. Test fit PCB1 in the slot and later it will be glued in place with cyanoacrylate after installing the pliant material PM1 around PVC1.

Move forward on PVC1 1.2 inches from the first slot, and saw the next slot for the driven element LI in a similar manner, to a width of 0.08 inches for #12 copper wire, and a depth of 0.1 inch so the wire when mounted will be flush with the surface of PVC1. Use two hacksaw blades mounted together side by side to get the proper width. Make LI out of 4.14 inches of copper wire. Shape it with needle nose pliers so it measures 1.7 inches wide on the top section, 0.35 inches downward on both ends, and 0.87 inches bent together and soldered to be 0.55 inches tall in the middle, forming a modified rectangle as in LI of FIG. 2. Shape the corners as sharply as possible but not so sharply that it stresses the copper.

Then move forward another 1.15 inches and saw another slot for the first director L2 to the same width, 0.08 inch, and a depth of a quarter inch. L2 is made from 4.76 inches of #12 copper wire. Shape the wire so its 1.45 inches on the top section, 0.93 inches downward on both ends, and 0.725 inches soldered together in the middle of the bottom side to form a complete rectangle.

Next, move forward to a point 2.9 inches from the LI slot. It should be a quarter inch from the front edge of the tube PVC1. Saw another slot for the second director L3, also 0.08 inch wide and a quarter inch deep. Make L3 from 4.4 inches of #12 copper wire. Shape a square loop that's 1.1 inches on each side. Solder the ends together in the middle of the bottom side to form a symmetrical square.

Lastly, slip the plastic foam pliant material PM1 around the PVC tubing behind the driven element LI. Install the reflector PCB1 in the open slot behind LI, center in position and tack in place with four points of cyanoacrylate against PVC1. Lay the Wi-Fi antenna upside-down in a flat area on a piece of cardboard, and install the loops LI, L2 and L3. Tack the loops sparingly with cyanoacrylate perpendicular to the body of PVC1 in their respective slots. Center the loops before the glue dries. Allow to dry completely before handling.

Slide the plastic foam material rearward against the reflector and tack it in place with cyanoacrylate. A slot of a quarter inch width should be formed behind the driven antenna element to accommodate the laptop computer or mobile device. The Wi-Fi antenna could also be constructed by injection molding plastic to the required specifications to avoid the labor-intensive costs of assembly. Construction of the Wi-Fi phase-matched coupled resonator antenna is complete.

The invention claimed is:

1. An apparatus for extending the range of 2.4 GHz Wi-Fi signals comprising:

a resonant loop shaped to the aperture of embedded antennas in a laptop computer or mobile device that provides near-field critical coupling of radio frequency energy when clipped on the bezel of the display of the laptop computer or mobile device;

an antenna that introduces no delay into the reception and transmission of Wi-Fi signals to the embedded antennas of the laptop computer or mobile device for the purpose of retaining stable additive properties of gain; and an integral hollow body structure for accurate visual sighting to a Wi-Fi hotspot.

* * * * *